United States Patent [19]

Kamegaya et al.

[11] 4,021,695

[45] May 3, 1977

[54] GASEOUS DISCHARGE DISPLAY PANEL OF MULTI-LAYER CONSTRUCTION

[75] Inventors: Takeo Kamegaya, Tokyo; Ryuichi Kaneko, Kawasaki; Hideomi Matsuzaki, Yokohama; Yutaka Imahori, Kawasaki, all of Japan

[73] Assignee: Nippon Hoso Kyokai, Tokyo, Japan

[22] Filed: Nov. 19, 1975

[21] Appl. No.: 633,260

[30] Foreign Application Priority Data

Nov. 22, 1974 Japan ..... 49-133606

[52] U.S. Cl. ..... 313/188; 313/209; 313/217; 313/220; 313/484

[51] Int. Cl.[2] ..... H01J 61/067; H01J 61/09

[58] Field of Search ..... 313/188, 209, 210, 217, 313/220, 484, 485, 491, 493

[56] References Cited

UNITED STATES PATENTS

| | | | |
|---|---|---|---|
| 3,836,810 | 9/1974 | Johanns et al. | 313/484 |
| 3,868,527 | 2/1975 | De Vries et al. | 313/220 X |
| 3,886,395 | 5/1975 | Eukushima et al. | 313/484 |
| 3,899,636 | 8/1975 | Chodil et al. | 313/484 X |
| 3,952,221 | 4/1976 | Kamegaya et al. | 313/493 X |

*Primary Examiner*—Gerard R. Strecker
*Attorney, Agent, or Firm*—Stevens, Davis, Miller & Mosher

[57] ABSTRACT

A gaseous discharge display panel of multi-layer construction comprises a transparent front sheet, a rear sheet, an intermediate sheet inserted between the front and rear sheets, said intermediate sheet having a number of elongated recesses for confining a number of discharge spaces extending in a plane of the intermediate sheet in parallel with each other and a number of through holes or recesses for constructing a number of communication channels, a number of anodes each arranged near one of the respective discharge space, a number of hollow cathodes arranged above the rear sheets, the other ends of the discharge spaces being communicated with the hollow cathodes through said communication channels, and a number of fluorescent layers applied on inner surfaces of the recesses formed in the intermediate sheet for confining the discharge spaces. The front, intermediate and rear sheets are connected to each other to form a hermetically sealed envelope and an ionizable gas is contained in the envelope.

25 Claims, 24 Drawing Figures

GASEOUS DISCHARGE DISPLAY PANEL OF MULTI-LAYER CONSTRUCTION

BACKGROUND OF THE INVENTION

The present invention relates to a gaseous discharge display panel of multi-layer construction comprising a transparent front sheet, a rear sheet and an intermediate sheet inserted between the front and rear sheets and having a number of elongated through holes for confining a number of discharge spaces, a number of anodes each arranged near one end of the respective through holes, a number of cathodes each being provided near the other end of the respective through holes and a number of fluorescent layers applied on walls confining the discharge spaces, whereby said sheets form a hermetically sealed envelope and an ionizable gas is contained in the envelope.

Such a gaseous discharge display panel has been disclosed in a specification of a copending U.S. Pat. application Ser. No. 491,634 filed on July 25, 1974, now U.S. Pat. No. 3,952,221. This gaseous discharge panel has several important advantages over the known gaseous discharge display panels described in specifications of U.S. Pat. Nos. 3,626,235, 3,631,530 and 3,743,879, i.e. since the discharge spaces and fluorescent layers extend in parallel with the display panel and discharge plasma is produced near the fluorescent layers, ultra-violet rays from the discharge plasma can excite strongly the fluorescent layers without being absorbed in the ionizable gas and thus the fluorescent layers emit light rays of high brightness. However after various experiments it has been found that this display panel has the following drawbacks. Since the cathodes provided in the discharge spaces face directly the fluorescent layers, the fluorescent layers may be easily blackend due to spattering of cathode materials. Therefore it is difficult to maintain high brightness of displayed images during the life time. Moreover in order to switch discharges in the sequential discharge spaces at a high rate scanning anodes are arranged between the intermediate and rear sheets so as to produce preliminary discharge between the scanning anodes and cathodes, but the light rays due to the preliminary discharges may be seen from the outside and thus the brightness of backgrounds of the displayed images is increased and the maximum contrast range is limited. Further the construction of the display panel is rather complicated and thus it is quite difficult to manufacture the display panel, particularly a large scale display panel. In order to display color images three adjacent elongated holes for confining discharge spaces must be arranged very close to each other, each one of these discharge spaces including a respective kind of three fluorescent materials for producing three primary colors. In such a color display panel mutual interferences between the respective primary colors may easily occur and thus the quality of the displayed color image might be deteriorated. This disadvantages will become more when the image dot density becomes high. It has been found experimentally that it is quite difficult to cement hermetically the front and intermediate sheets and thus the gas may flow between the adjacent discharge spaces.

In order to form a number of small holes in the intermediate sheet with a high density by mean of, for example etching process, the thickness of the intermediate sheet must be very thin and this causes further difficult to obtain the complete hermetic seal.

SUMMARY OF THE INVENTION

The present invention is to provide an improved gaseous discharge display panel which eliminates the above drawbacks while maintaining the above mentioned advantages of the display panel disclosed is the copending application. A gaseous discharge display panel according to the invention comprises a transparent front sheet of an electrically insulating material, a rear sheet of an electrically insulating material, an intermediate sheet of an electrically insulating material inserted between the front and rear sheets, and having a number of discharge spaces, the discharge spaces being formed by elongated recesses extending along the plane of the intermediate sheet in parallel with each other, a number of anodes each provided near one end of the respective discharge spaces, a number of hollow cathodes arranged above the rear sheet, a number of communication channels in the form of through holes, conduits or recesses formed in the intermediate sheet for communicating the other ends of the discharge spaces with the hollow cathodes, and a number of fluorescent layers applied on walls confining the discharge spaces, whereby said sheets form a hermetically sealed envelope and an ionizable gas is contained in the envelope.

DESCRIPTION OF THE PREFERRED EMBODIMENTS

Figure 1A:
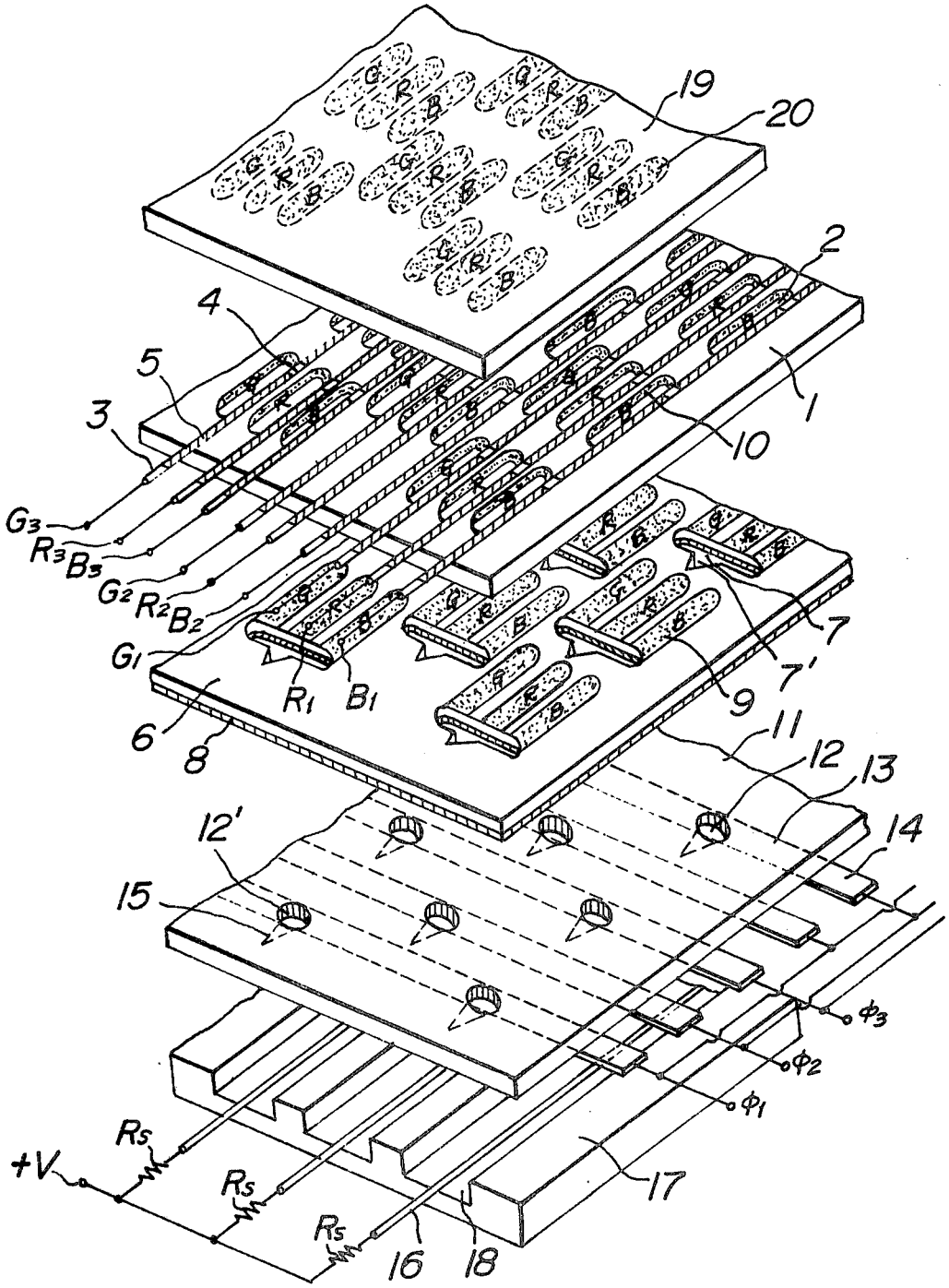
FIGS. 1(*a*) and 1 (*b*) are exploded perspective and side views, respectively of an embodiment of a gaseous discharge disply panel according to the invention and FIG. 1 (*c*) is a plan view showing a portion of the panel in an enlarged scale.
Figure 1B:
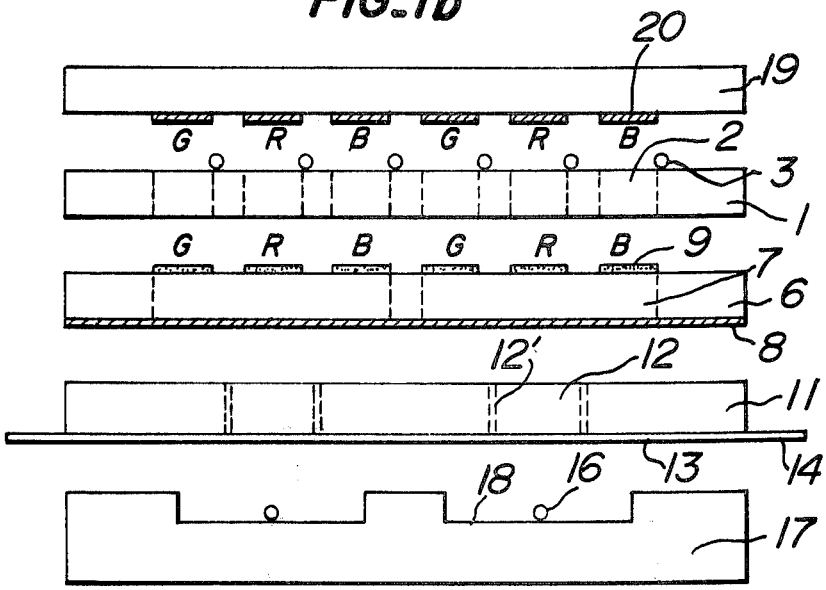
Figure 1C:
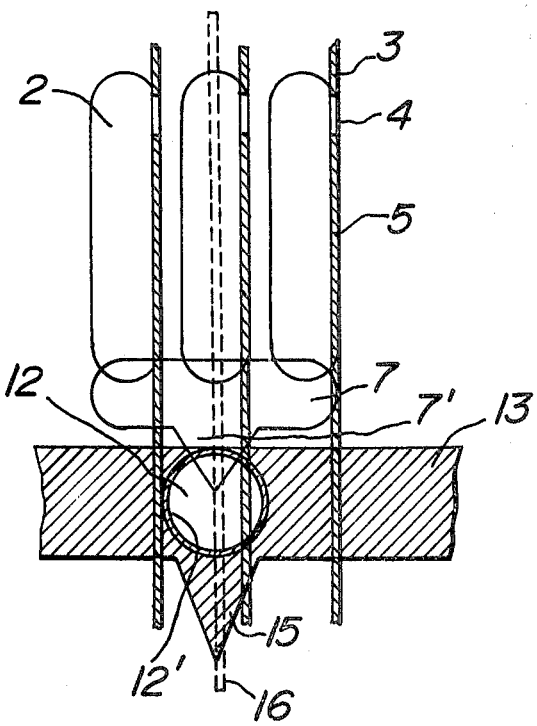

FIGS. 1(*a*) and 1(*b*) are exploded perspective and side views, respectively showing a construction of a first embodiment of a gaseous discharge display panel for displaying a color image according to the invention. FIG. 1(*c*) is a plan view showing a discharge unit of the display panel in an enlarged scale. The display panel comprises a first intermediate sheet 1 of an electrically insulating material such as glass and ceramic. In this sheet 1 there are formed a number of elongated through holes 2 which extend in a plane of the sheet in parallel with each other. Each hole 2 constitutes a discharge space. A number of the discharge spaces are divided into a number of groups, each group consisting of three adjacent through holes 2. Each of these groups forms a respective dot of the color image to be displayed. The display panel comprises a number of anode means formed by wire-shaped conductors 3 arranged along the longer sides of the elongated holes 2. The anode conductors 3 coated with an insulating material such as glass except for that portions 4 thereof which situate near one end portions of the elongated through holes 2. These anode portions 4 operate as anodes and thus are termed as display anodes. The display panel further comprises a second intermediate sheet 6 of an electrically insulating material such as glass and ceramic. The second intermediate sheet 6 has formed therein a number of elongated through holes 7, each confining a communication channel for constructing the discharge path. The through hole 7 extends in a direction perpendicular to the longitudinal direction of the elongated holes 2 formed in the first intermediate sheet over the three adjacent holes 2 of the same group. As shown in FIG. 1(*c*) the communication hole 7 partially communicates with the other end portions of these three elongated through holes 2, these portions being remote from the one end portions near which the anode portions 4 are arranged. The through hole 7 has a projection 7' having a sharp corner. As explained later these projections 7' are communicated with hollow cathode so as to form the discharge paths for transporting ions and excited atoms produced by the discharge into the display side. The second intermediate sheet 6 has applied on its rear surface an opaque layer 8 which may be formed by applying opaque paint on the rear surface. This opaque layer 8 can prevent light rays due to a preliminary discharge which will be explained later from reaching the display side. On that portions of the front surface of the second intermediate sheet 6 which face the through holes 2 in the first intermediate sheet 1 are applied red (R), green (G) and blue (B) fluorescent layers 9 for emitting red, green and blue lights, respectively. If desired, red, green and blue fluorescent layers 10 may be applied on inner surfaces of the through holes 2.

The display panel further comprises an electrically insulating flat sheet 11 of glass or ceramic having a number of through holes 12. On inner surfaces of these holes 12 are applied electrically conductive layers 12' of, for example, nickel so as to form a number of hollow cathodes. The rear surface of the sheet 11 is provided with a number of strip-shaped conductors 13 for electrically connecting a plurality of hollow cathodes 12'. The conductors 13 have connected thereto lead-out portions 14 to which signal conductors are connected. The cathode coupling conductor 13 has a number of triangular projections 15 at positions of the hollow cathodes 12', said projections operating to transport the preliminary glow discharge into the display side in a positive and smooth manner. There is further provided a flat rear sheet 17 of electrically insulating material such as glass and ceramic. This rear sheet 17 has formed on its front surface a number of grooves 18 in each of which is arranged a scanning anode 16. Between the projections 15 of the cathode conductors 13 and the scanning anodes 16 is produced the preliminary glow discharge which moves sequentially along the scanning anodes 16.

In front of the front surface of the first intermediate sheet 1 is arranged a transparent front sheet 19 of an electrically insulating material such as glass. On that portions of the rear surface of the front sheet 19 which face the holes 2 formed in the sheet 1 are applied red (R), green (G) and blue (B) fluorescent layers 20. The fluorescent layers 20 must be thin so as to transmit light rays emitted from the fluorescent layers 9 without absorbing them.

The above sheets 1, 6, 11, 17 and 20 are hermetically cemented to each other with the aid of a suitable adhesive to form a hermetically sealed envelope and in this envelope is contained an ionizable gas such as neon, argon, helium, xynon, krypton, hydrogen, nitrogen and mercury or mixtures thereof. Since the front and rear sheets 19 and 17 constitute front and rear walls of the envelope, they may be relatively thick.

The general construction of this embodiment of the display panel according to the invention has been described. Now novel constructional features of the display panel will be further explained in detail. According to the invention the discharge spaces are formed in the thin and flat intermediate sheet 1 in the form of the elongated sections 2 which extend in the plane of the sheet 1. Along the longer sides of the holes 2 are arranged the wire-like anode conductors 3 having the display anodes 4 arranged near the one end portions of the elongated discharge spaces. The second intermediate sheet 6 has formed therein the through holes 7 each of which communicates the other end portions of the three adjacent discharge spaces 2 of the same group with the common hollow cathode 12' provided in the sheet 11 so as to form the discharge path. In the operation the discharge is formed between the hollow cathode 12' and the display anode 4 through said discharge path. In such a construction the hollow cathode 12' is far away from the fluorescent layers 9, 10 and 20 and thus the spattering of the cathode material due to ion bombardment does not affect the fluorescent layers. Therefore the layers can emit light rays at a high intensity during a long time. Moreover since use is made of the hollow cathode 12' the cathode fall voltage can be maintained lower and a large discharge current can be flown in a stable manner.

In order to display the color image in an interlaced scanning mode the three adjacent discharge units form a group confine the image dot and a number of dots are arranged in a zig-zag manner in the direction of the cathode coupling conductor 13. In this case a number of hollow cathodes 12' aligning in the direction perpendicular to the anode conductor 3 are commonly connected to the cathode conductor 13 which is connected to the lead-out connector 14.

As described above in case of displaying the color image by means of the gaseous discharge display panel it has been known to utilize ultra-violet rays produced by the discharge to excite the fluorescent materials. Various attempts have been made for realizing the above known method, but none of them has been succeeded owing to the low brightness. This is due to the fact that owing to the improper construction the intensity of the ultra-violet rays produced from the plasma formed by discharge are weak, a distance between the plasma forming part and the fluorescent materials are very long so that the ultra-violet rays are considerably attenuated by the sealed gas before reaching the fluorescent materials, the applied area of the fluorescent materials and the surface area of the plasma in contact with the fluorescent materials are small, and thus the luminous intensity is totally small.

According to the invention in order to obviate the above disadvantages the fluorescent materials are applied both to the inner surface of the front sheet 19 arranged in front of the display units, to the front surface of the second intermediate sheet 6 and to the inner surface of the through holes 2, if any so that the plasma and fluorescent materials are situated very close to each other to decrease the attenuation of the ultra-violet rays, and they are opposed to each other with a large area. Moreover the luminous light can be inspected both as the reflected and transmitted lights. In this manner it is possible to obtain the displayed color image of the high brightness.

According to the invention the common hollow cathode 12' is used for the adjacent three discharge spaces 2 of the same group, so that the number of the hollow cathodes can be reduced by three times as compared with that of the discharge spaces. Therefore the display panel according to the invention can be manufactured very easily and precisely. Since use is made of the hollow cathodes 12' the discharge voltage can be made lower and the supply current can be increased, so that the stability of operation can be achieved.

Moreover according to the invention in the second intermediate sheet 6 are formed a number of elongated through holes 7 having the sharp projections 7' which communicate with the hollow cathodes 12' and thus the plasma of the preliminary discharge formed between the scanning anode 16 and the cathode projection 15 of the cathode coupling conductor 13 can be easily diffused or moved into the display side so as to obtain the low voltage discharge and high speed operation of the discharge unit constituting the picture element.

Figure 2:
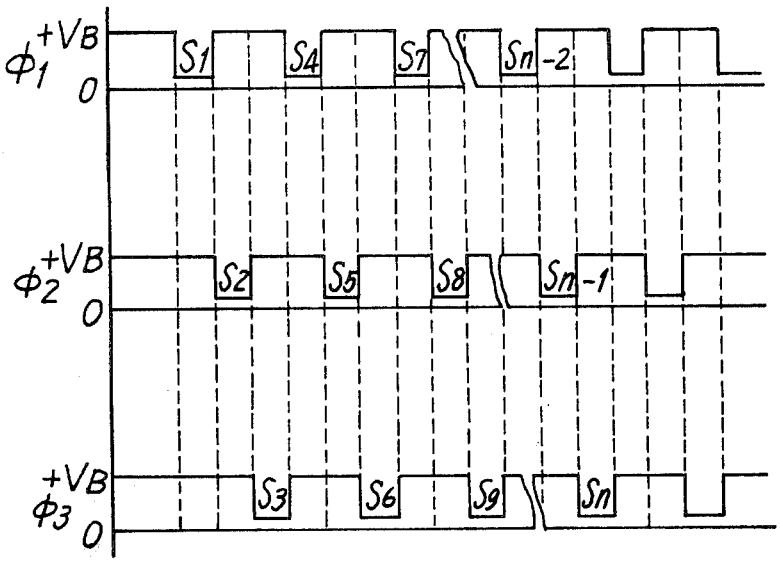
FIG. 2 shows waveforms of driving voltages applied to cathodes of the display panel.

The glow discharge formed between the scanning anode 16 and the cathode projection 15 is selectively scanned or moved by means of a three-phase clock signal of square wave form as shown in FIG. 2 and at the transferred position the discharge-luminescence is formed between the hollow cathode 12' and the display anode 4 with the aid of the preliminary glow discharge to display the image. Such a driving method has been adopted in the known self-scan panel display device, but in the known display panel the discharge plasma formed in the discharge unit at the display side extends in the direction normal to the display surface and thus the construction and operation of the known display panel are basically different from those of the display panel according to the invention. That is to say in the display panel according to the invention the three electrode groups, i.e. the scanning anode group 16, the cathode and cathode coupling conductor groups 12' and 13 and the display anode group 4 are arranged in the gas atmosphere in the electrically insulated manner and when a voltage difference which can start the discharge is applied to given cathode and anode, the discharge can be easily produced locally at the crossing points of these electrodes. Due to this fact it is possible to attain easily the basic operation of the image display, that is given display can be positioned quickly in response to the operation by means of addressing or scanning the plasma. Moreover if the discharge voltage or current at the display anode is modulated by the image signal, the luminous intensity of successively selected discharge units varies in accordance with the image signal to change the brightness at that position of the image. Therefore when the addressing or scanning and the corresponding brightness variation are repeatedly effected over the whole panel surface, the two-dimensional display of image is repeatedly carried out.

In the embodiment shown in FIG. 1, each scanning anode 16 is applied a d.c. anode voltage of, for example, positive 250 V through respective stabilizing resistors Rs and the cathode lead wires 14 coupled to the cathode conductors 13 are connected to a pulse generator (not shown) which produces a pulse series of square waveforms as shown in FIG. 2. Therefore during the scanning period the pulse voltage is applied across at least one pair of the scanning anode and cathode. In practice N-phase pulses may be applied simultaneously to every N electrodes or successive pulses of a pulse series occuring substantially at the pulse interval may be applied to the successive cathode lead wires 14. In FIG. 1(*a*) $\phi_1$, $\phi_2$ and $\phi_3$ illustrate a phase sequence of the pulse voltages applied to the cathode lead wires 14. Further in order to flyback the scanning point in the plane scanning from an end position to a start position for a next plane scanning after one plane scanning has been completed, a reset cathode means is provided at upper or lower end of the cathode coupling conductor group, to which a voltage pulse is applied. Such known scanning and driving methods may be applied to the display panel according to the invention.

In order to drive the discharge units at the display side, use is made of plasma due to the glow discharge on the scanning side at the transferred position. In the above embodiment the display anodes $R_1$, $R_2$ ... $R_n$; $G_1$, $G_2$ ... $G_n$ and $B_1$, $B_2$ ... $B_n$ for displaying red (R), green (G) and blue (B) colors, respectively are driven by the display anode driving amplifiers (not shown) and the red, green and blue fluorescent materials are excited by means of ultra-violet rays produced by discharge so as to display the color image. When a television color image is to be displayed by the display panel of the present embodiment, the display anodes are driven in parallel with each other so that all picture elements of one scanning line radiate simultaneously for a given time period.

When the presently used standard television signals are supplied at the input modulating signals, two memories each having the same capacity as the number of the display anodes are used. At first the input signal is sampled and samplings are successively stored in the first memory. For example, the red, green and blue signals can be derived from the input signals with the aid of a color demodulating circuit and these color signals are sampled independently from each other and the samplings are stored serially in the first memory. In this case one horizontal scanning period or a portion thereof to be displayed is divided into the same number as the number of sets of the R, G and B display anodes.

Next in syncrhonism with the switching of the cathodes the content of the first memory is simultaneously transferred to the second memory. The content stored in the second memory represents the light amounts which should be radiated from the discharge units until the next transferring instance, so that each memory element drives each display anode through converting and driving circuits. The converting circuit is to convert the picture information stored in the second memory into a brightness modulating signal suitable for driving the display panel. For example if the information is stored in the memory as voltage values and the brightness modulation of the discharge units is effected by controlling the discharge current, the converting circuit may be constructed by a voltage-current converting circuit. If the memory is of a digital memory in which the information is stored as PCM signals, the converting circuit may be a preset counter. Further if the memory stored the voltage information and the driving circuit is a brightness modulator of PWM system, the converting circuit may be consisted of a comparison circuit for comparing the voltage stored in the memory with a sawtooth wave signal which is synchronized with the memory transferring period or of a voltage controlled monostable multivibrator. The known technique can be applied to the converting circuit and thus the detailed explanation thereof is omitted.

In the above explanation the interlace scanning is not considered. In order to display the image with interlace scanning, the discharge unit group arranged in a zig-zag manner on both sides of the same cathode coupling conductor 13 are divided into upper and lower arrays and the discharge units of the upper arrays are irradiated only in even fields and the discharge units of the lower arrays are operated only in odd fields. Therefore the driving methods must be somewhat modified.

In the embodiment described above there are formed a number of through holes 2 in the first intermediate sheet 1 and the front sheet 19 and the second intermediate sheet 6 are cemented to the front and rear surfaces of the first intermediate sheet 1, respectively. In such a construction when the thickness of the first intermediate sheet 1 is thin, ion loss at the discharge unit increases so that the discharge voltage becomes higher. In order to reduce this increased discharge voltage an electrically insulating sheet having formed therein a number of through holes a pattern of which is the same as that of the through holes 2 in the first intermediate sheet 1 may be adhered to a front and/or a rear surface of the first intermediate sheet 1.

Figure 3A:
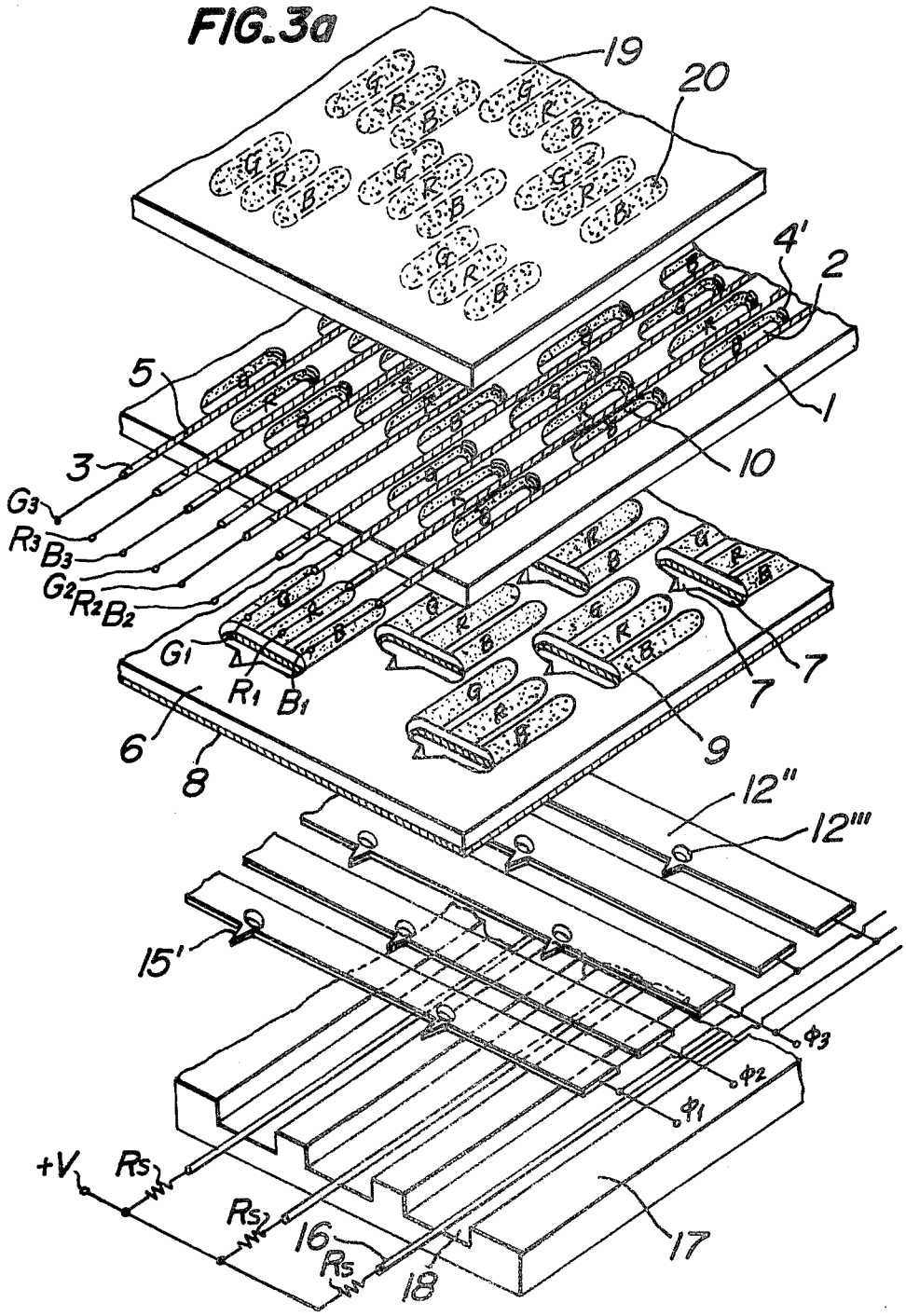
FIG. 3 (*a*) is an exploded perspective view of another embodiment of the display panel according to the invention and FIG. 3 (*b*) is a plan view showing a part thereof in an enlarged scale.
Figure 3B:
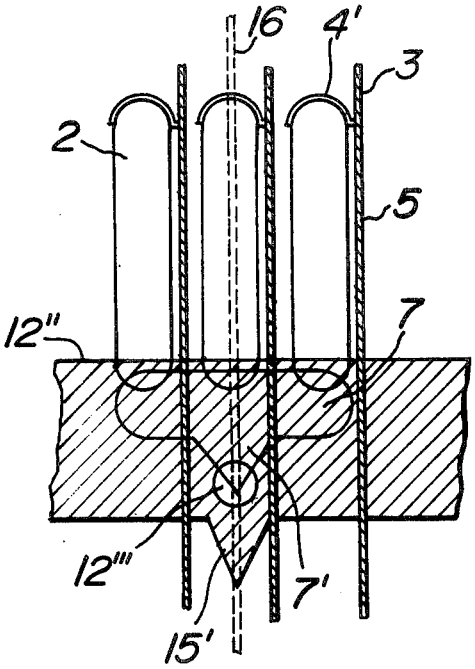

FIG. 3(*a*) is an exlopded perspective view of another embodiment of the display panel according to the invention and FIG. 3(*b*) is an enlarged plan view of a discharge unit thereof. In this embodiment the cathode of the discharge unit comprises strip-shaped conductive plate 12'' of nickel or nickel iron alloy which has formed therein a number of holes 12'''. The anode means comprises a number of wire-shaped conductors 3 having coated thereon an insulating meterial 5 and electrically conductive coatings 4' which are applied on the inner surfaces of the one end portions of the holes 2 and are connected to the conductors 3. As clearly shown in FIG. 3(*b*) the hole 12''' is formed in the plate 12'' at such a position that it communicates with the projection 7' of the hole 7 in the second intermediate sheet 6, but the plate 12'' substantially covers the hole 7. Further the plate 12'' has a triangular projection 15' at a position of the hole 12'''. The projection 15' extends in the direction of the scanning anode 16 so as to produce easily the preliminary glow discharge therebetween. In this embodiment the hole 12''' in the cathode plate 12'' cannot be seen from the display side through the discharge space holes 2 and thus the diameter of the hole 12''' can be made larger than that of the known display panel so that plasma due to the preliminary discharge produced at the rear side of the cathode plate 12'' can easily diffuse to the display side to decrease the driving voltage for the anode and to make the response speed high. The other construction of the present embodiment is entirely same as that of the first embodiment and the operational function is also the identical.

Figure 4A:
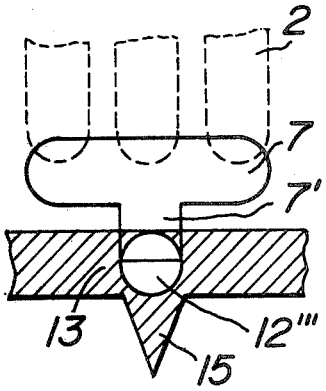
FIGS. 4 (*a*) and 4 (*b*) are plan views illustrating two embodiments of a communication channel of the display panel according to the invention.
Figure 4B:
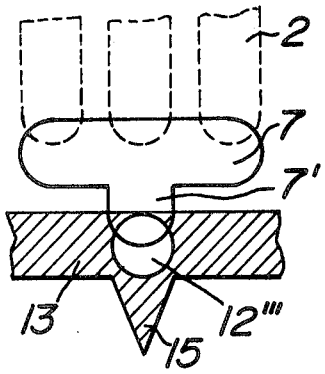

FIGS. 4(*a*) and 4(*b*) are plan views showing two alternatives of shapes of the projection 7' of the through hole 7 formed in the second intermediate sheet 6. The projection 7' shown in FIG. 4(*a*) has a rectangular shape and the projection 7' of FIG. 4(*b*) has a circular shape.

Figure 5:
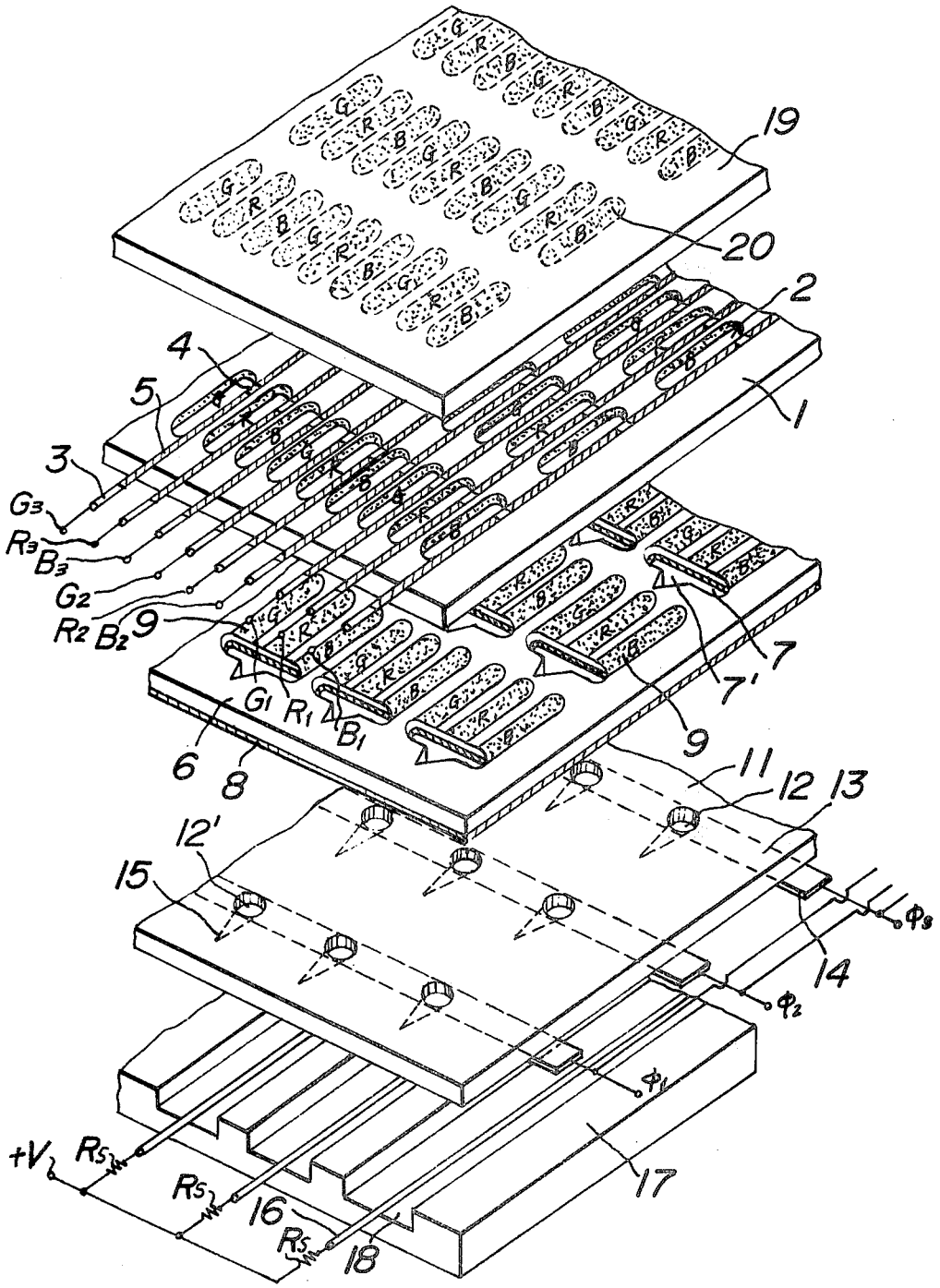
FIG. 5 is an exploded perspective view showing another embodiment of the display panel according to the invention.
Figure 6A:
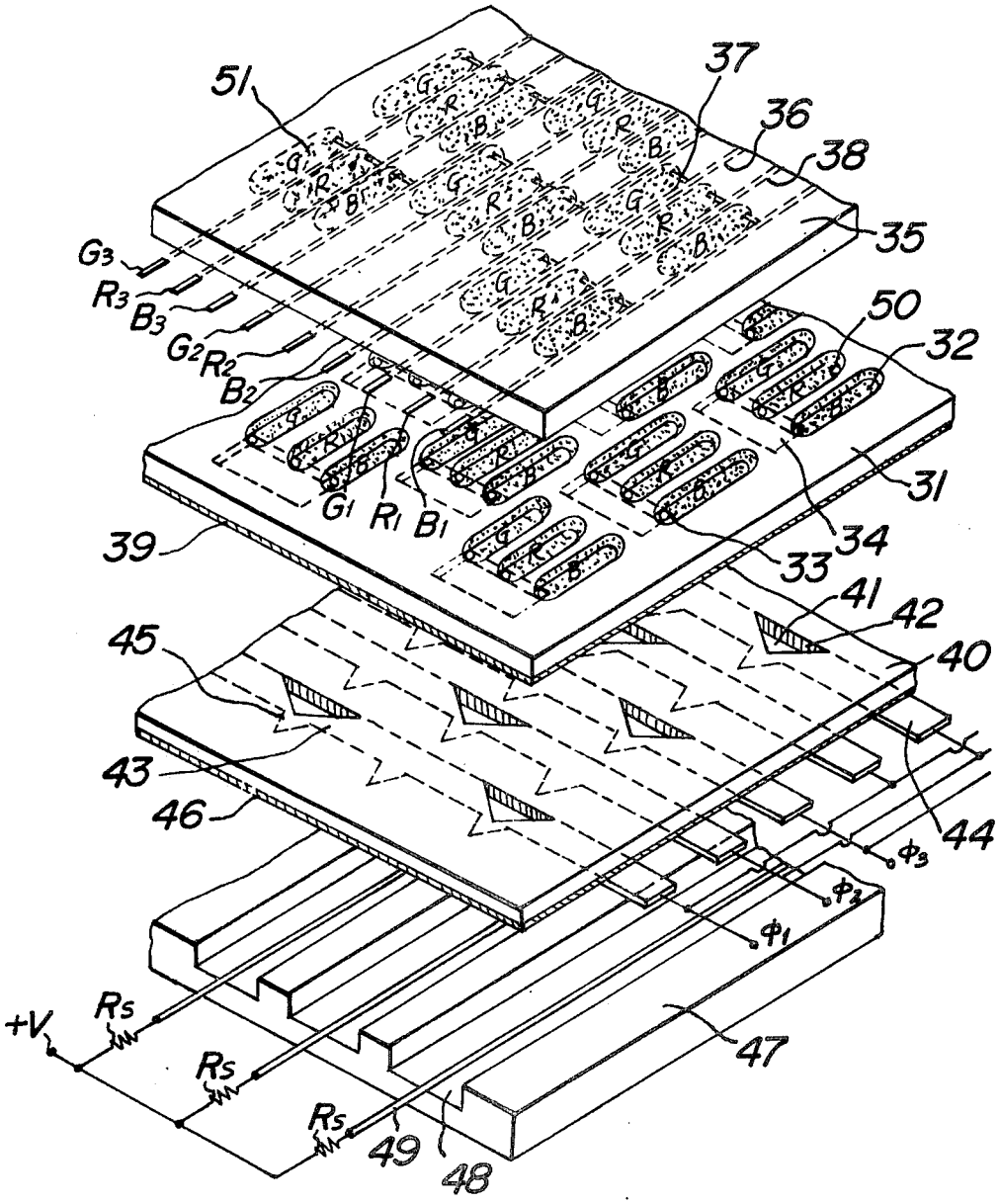
FIGS. 6 (*a*) and 6 (*b*) are exploded perspective and cross sectional views, respectively of another embodiment of the display panel according to the invention, FIG. 6(*c*) is a cross sectional view of the complete display panel and FIG. 6(*d*) is a plan view showing a part thereof.
Figure 6B:
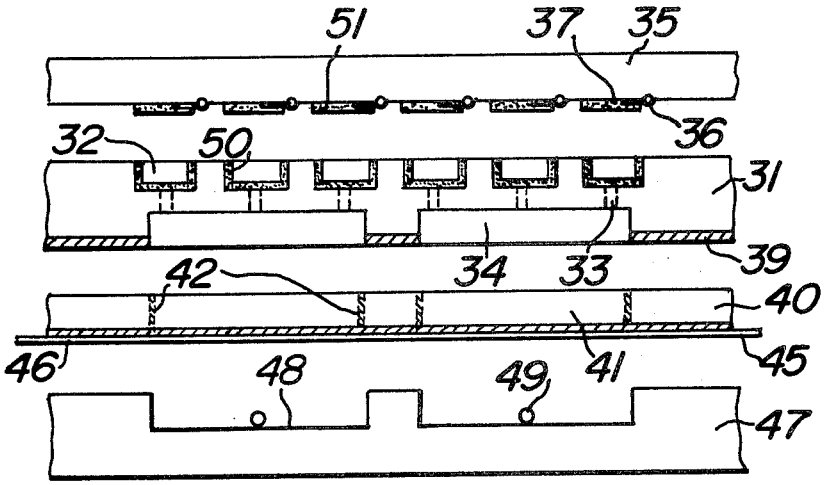
Figure 6C:
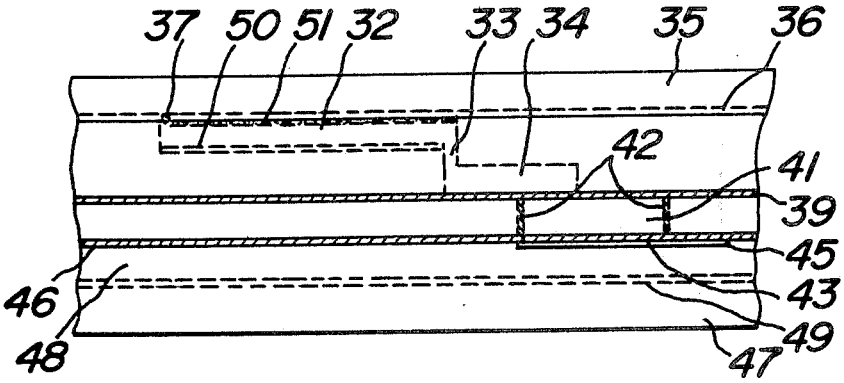
Figure 6D:
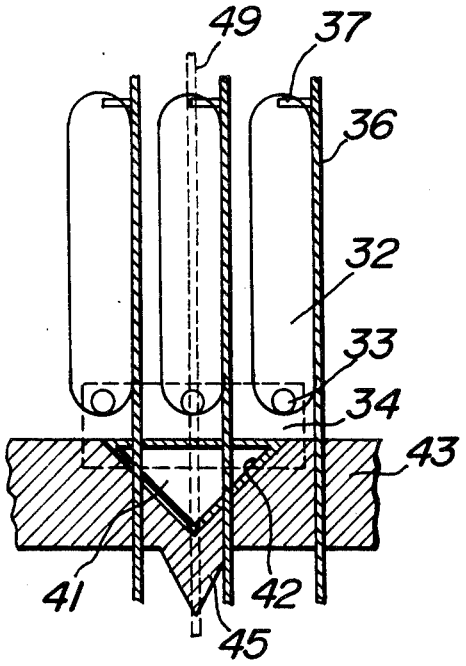

FIG. 5 is an exploded perspective view illustrating another embodiment of the display panel according to the invention which is suitable for displaying a color image with a non-interlaced scanning mode. For this purpose in this embodiment a number of the discharge units are arranged regularly in a matrix form. That is the discharge spaces 2 are aligned regularly in both orthogonal directions of the matrix arrangement. The construction and operation of each discharge unit are entirely the same as those of the embodiment shown in FIG. 1.

According to the invention the discharge spaces are formed as the elongated sections extending in the plane of the panel. In the embodiments shown in FIGS. 1, 3 and 5 the discharge spaces are constructed by the through holes 2 formed in the intermediate sheet 1. These through holes 2 may be formed by photo-etching or chemical etching. In order to obtain a higher density of the image dots the through holes 2 must be narrow and must be close to each other. Therefore the intermediate sheet 1 must be thin. But it has been formed that it is a quite difficult to handle the thin sheet, particularly in case of manufacturing the display panel of a large area. In order to avoid such a disadvantage according to another embodiments of the invention the discharge spaces are formed by recesses formed in a front surface of the intermediate sheet. Such embodiments will be explained below.

FIGS. 6(*a*) and 6(*b*) are exploded perspective and sectional views, respectively of another embodiment of the display panel according to the invention and FIGS. 6(*c*) and 6(*d*) are cross sectional and plan views illustrating a discharge unit thereof in an enlarged scale. This display panel comprises a single intermediate sheet 31 of an electrically insulating material such as glass and ceramic. On a front surface of the intermediate sheet 31 there are formed a number of elongated recesses 32 extending in the plane of the panel in parallel with each other, these recesses confining the discharge spaces. In order to display a color image the recesses are divided into a number of groups each comprising three adjacent recesses. On a rear surface of the intermediate sheet 31 there are formed a number of recesses 34 which extend in the direction parpendicular to the axial direction of the elongated recesses 32 formed on the front surface to an extent that the recess 34 can cover the these adjacent recesses 32 of a group. The intermediate sheet 31 further comprises a number of conduits 33 each formed as a through hole having a small cross section and a short length. The conduits 33 are also divided into a number of groups each comprising three adjacent conduits which communicate the other end portions of the three adjacent recesses 32 of a group with a corresponding recess 34 so as to form three discharge paths.

The display panel further comprises a transparent front sheet 35 of an electrically insulating material such as glass. On a rear surface of the front sheet 35 are provided a number of wire-shaped conductors 36 and a number of anode projections 37 which are connected to the anode conductors 36. The anode conductors 36 are covered with coatings 38 of an electrically insulating material such as glass. As clearly shown in FIG. 6(*d*) the projection 37 are provided at such positions on the rear surface of the front sheet 35 that they situate near the one end portions of the recesses 32, when the front and intermediate sheets 35 and 31 are hermetically cemented to each other.

On the rear surface of the intermediate sheet 31 is applied an opaque layer 39. This layer may be formed by applying an opaque paint on the rear surface of the sheet 31.

The display panel of this embodiment includes a cathode sheet 40 of an electrically insulating material such as glass and ceramic. The sheet 40 has formed therein a number of through holes 41 of the triangular shape. On inner surfaces of the holes 41 are applied electrically conductive coatings of, for example nickel to form a number of hollow cathodes 42. On the rear surface of the sheet 40 are arranged a number of cathode coupling conductors 43 which may be formed by vapour deposition of an electrically conductive material such as nickel. To the conductors 43 are connected lead-out conductors 44. The cathode coupling conductors 43 have projections 45 having sharp corners which serve as discharge transferring electrodes. On the rear surface of the cathode sheet 40 is applied an opaque layer 46.

The display panel further comprises a rear sheet 47 of an electrically insulating material such as glass and ceramic. On a front surface of the rear sheet 47 are formed a number of parallel grooves 48 which extend in the direction perpendicular to the cathode coupling conductors 43. In these grooves 48 are inserted a number of scanning anode wires 49. The projections 45 of the conductors 43 extend in the direction of the scanning anodes 49 so as to produce preliminary glow discharge therebetween. By driving the cathode conductors 43 sequentially the preliminary discharge moves in the direction of the scanning anodes 49. On inner surfaces of the three adjacent recesses 32 of a group there are applied three kinds of fluorescent layers 50 for radiating blue, red and green lights for displaying the color image. In the present embodiment on the rear surface of the front sheet 35 are also applied three kinds of fluorescent layers 51 at such positions that they face the corresponding recesses 32 in the intermediate sheet 31.

In the complete display panel the front sheet 35, the intermediate sheet 31, the cathode sheet 40 and the rear sheet 47 are stuck and cemented to each other. In this case these sheets may be cemented with the aid of glass flit powder so as to avoid erroneous discharge between the adjacent discharge spaces. The front and rear sheets 35 and 47 form front and rear sides of a hermetically sealed envelope and an ionizable gas is contained in the envelope.

According to this embodiment the discharge spaces are constructed by the recesses 32 formed on the front surface of the intermediate sheet 31 and thus the very shallow recesses 32 can be formed in the relatively thick intermediate sheet 31, so that one can easily handle the thick intermediate sheet 31. The discharge spaces are confined by the recesses 32 and thus the erroneous discharge is hardly occurred between the adjacent discharge spaces even if the discharge spaces are arranged very close to each other with a higher density. Moreover the recesse 34 formed on the rear surface of the intermediate sheet 31 has a relatively large volume and can store a large amount of ions and excited atoms and the conduit 33 has a small cross section and a short length. Therefore the discharge can be easily produced in the discharge space. Further the cathode 42 operates as a hollow cathode which can decrease the cathode fall voltage and can supply a large discharge current in a stable manner. The common hollow cathode 42 is communicated with the recess 34 on the rear surface of the sheet 31, so that the preliminary discharge produced between the scanning anode 49 and the cathode projection 45 is not visible from the display side so as to increase the contrast of the displayed image. The hollow cathodes 42 do not face directly the fluorescent layers 50, 51 and thus the fluorescent layers are hardly blackened by the cathode spattering so as to attain the high brightness for a long time.

Figure 7A:
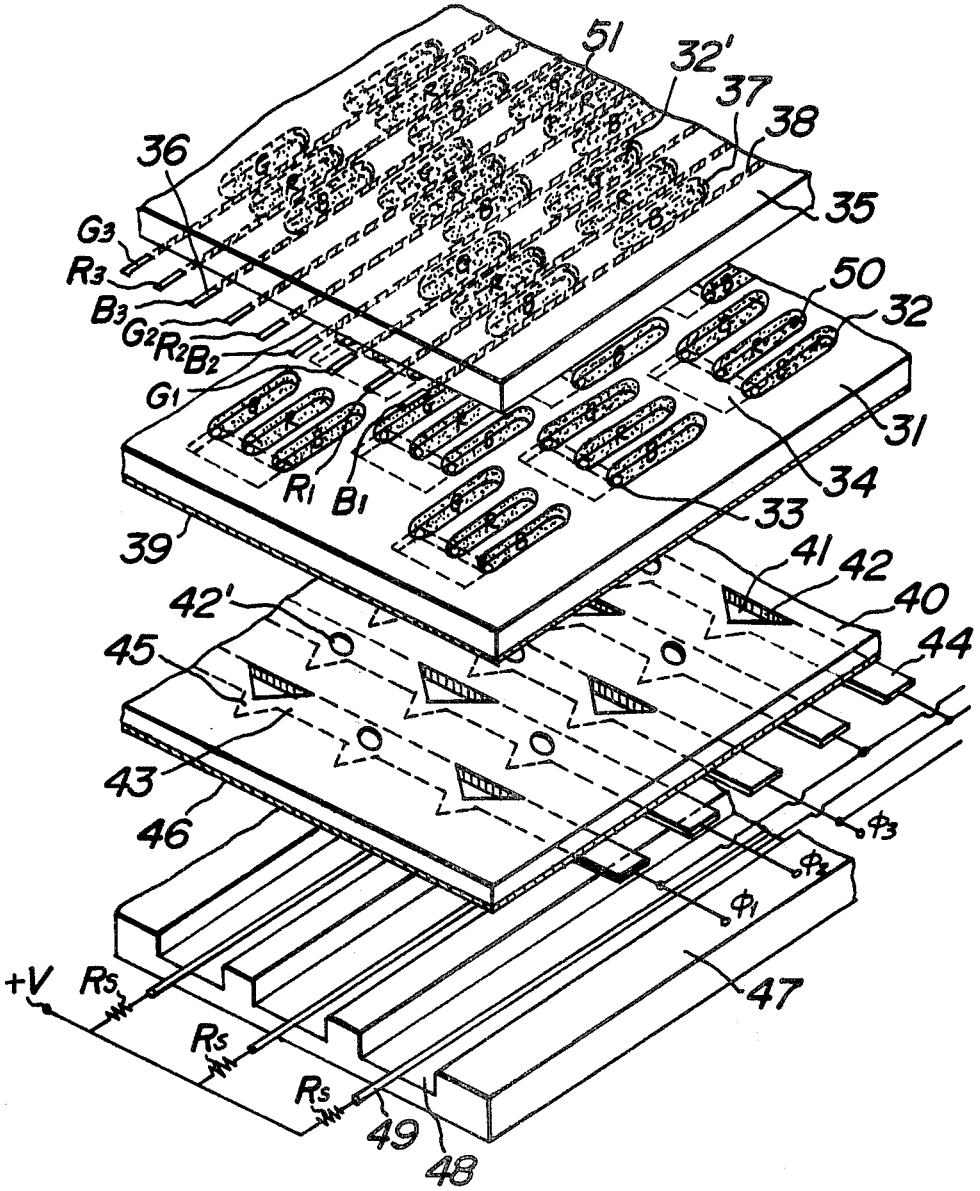
FIGS. 7(*a*) and 7(*b*) are exploded perspective and sectional views of still another embodiment of the display panel according to the invention.
Figure 7B:
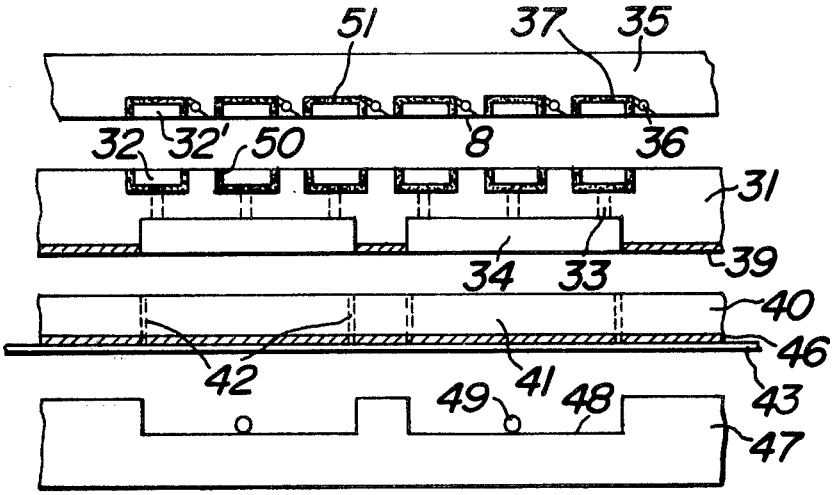

FIGS. 7(*a*) and 7(*b*) are exploded perspective and cross sectional views showing still another embodiment of the display panel according to the invention. The present embodiment is similar to that shown in FIG. 6 and corresponding parts are designated by the same reference numerals. An intermediate sheet 31 has formed on its front surface a number of elongated recesses 32 confining a number of discharge spaces. The intermediate sheet 31 has further formed therein a number of recesses 34 and conduits 33 for constructing a number of communication channels for communicating the other ends portions of the recesses 32 with common hollow cathodes 42. In this embodiment on a rear surface of a transparent front sheet 35 are formed a number of elongated recesses 32′ at such positions that these recesses 32′ just face the corresponding recesses 32 formed in the intermediate sheet 31. In the embodiment shown in FIG. 6 the discharge space is formed by the recess 32. After various experiments it is found that it is rather difficult to manufacture deep recesses with the photoetching treatment and when the recesses 32 are too shallow, ion loss at the discharge unit might be increased and thus the discharge voltage becomes higher. Moreover it is difficult to apply the three kinds of the fluorescent layers 50 onto the deep recesses. These drawbacks can be avoided in the embodiment of FIG. 7. In this embodiment each discharge space is formed by a pair of recesses 32 and 32′, so that these recesses may be shallow. The shallow recesses can be manufactured easily and precisely with using the conventional etching technique. Moreover the fluorescent layers 50 and 51 can be easily applied onto the shallow recesses 32 and 32′, respectively by means of know screen printing method, spraying method and desposition method which have been utilized in manufacturing cathode ray tubes.

In the present embodiment the cathode plate 40 has further formed therein a number of small through holes 42' at intermediate positions of successive hollow cathodes 42. On an inner surface of the hole 42' is applied an electrically conductive coating which is connected to a cathode coupling conductor 43 so as to form a preliminary hollow cathode. This preliminary hollow cathode 42' serves to keep temporaly the preliminary glow discharge in a stable manner while the glow discharge moves between the successive hollow cathodes 42. The dimension of the preliminary hollow cathode 42' may be determined in accordance with a kind of the contained gas, a pressure, a value of the preliminary glow discharge current. The other construction and operation of the display panel of FIG. 7 are entirely same as those of the display panel shown in FIG. 6.

Figure 8A:
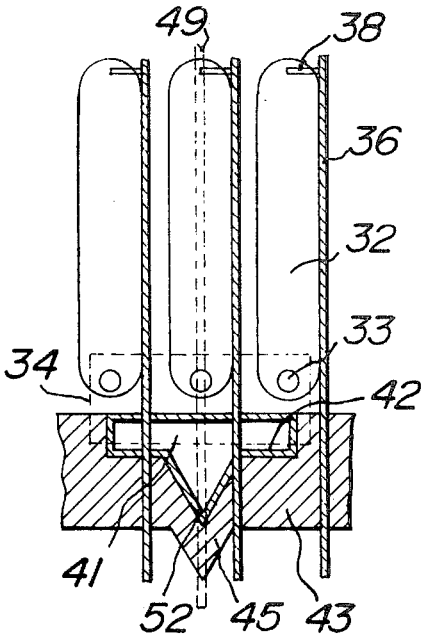
FIGS. 8(*a*), 8(*b*) and 8(*c*) are plan views illustrating three embodiments of the hollow cathode.
Figure 8B:
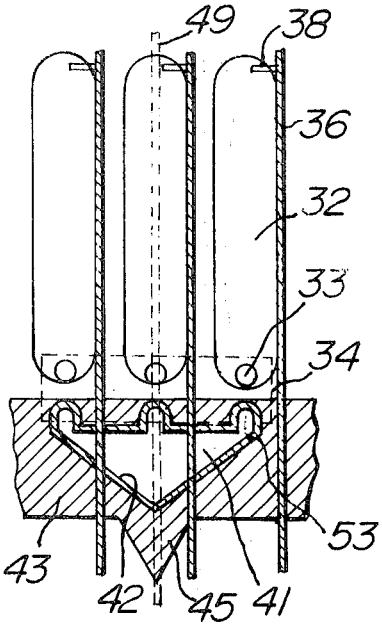
Figure 8C:
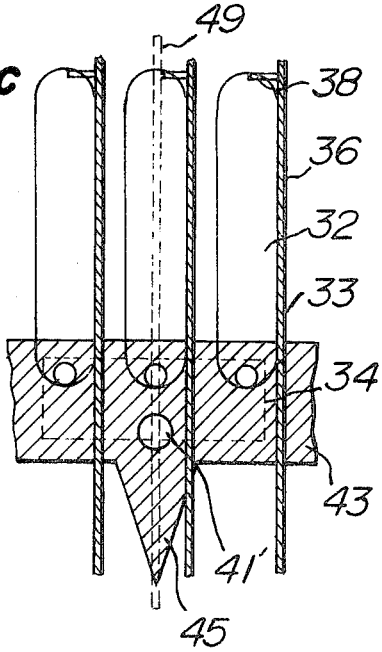

FIGS. 8(*a*), 8(*b*) and 8(*c*) are plan views illustrating three alternatives of the hollow cathode 42 of the display panel according to the invention. A hollow cathode shown in FIG. 8(*a*) has a rectangular portion and a triangular portion. The triangular portion has a sharp corner 52 extending in parallel with the scanning anode 49. A hollow cathode of FIG. 8(*b*) has generally a triangular shape and has three adjacent semi-circular projections 53 which correspond to the three adjacent discharge paths. These hollow cathodes can stabilize the cathode discharge. FIG. 8(*c*) shows another embodiment of a hollow cathode which is constructed by a hole 41' formed in a conductive plate 43. In this construction the front surface of the plate 43 serves as a cathode of a displaying discharge unit and a rear surface of the plate serves as a cathode for a scanning glow discharge. Charged particles produced at the rear surface due to the scanning glow discharge can move or diffuse to the front surface through the hole 42'.

Figure 9:
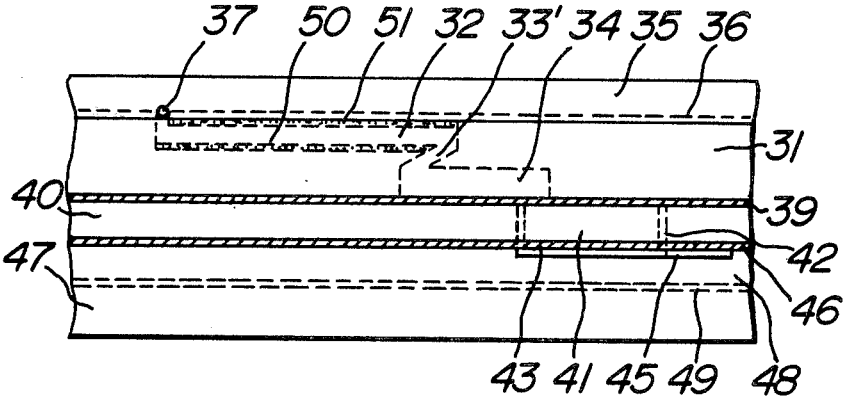
FIG. 9 is a cross sectional view of another embodiment of the display panel according to the invention.

FIG. 9 is a cross sectional view of a discharge unit of another embodiment of the display panel according to the invention. In this embodiment the other end portion of the recess 32 is communicated with the recess 34 by means of an inclined conduit 33' and a portion of the recess 34 is extended under the recess 32. Such an inclined conduit 33' can positively block the stray light from the glow discharge and the cathode spattering so as to display the image with a wider contrast range. The conduit 33' has a circular cross section, but it may be rectangular or oval.

In the embodiments explained above the scanning anodes 16, 49 are arranged between the hollow cathodes and the rear sheet and the display discharge units are driven with utilizing the preliminary glow discharge produced between the cathodes and scanning anodes. According to the present invention the scanning anodes are not always necessary and may be dispensed with.

Figure 10:
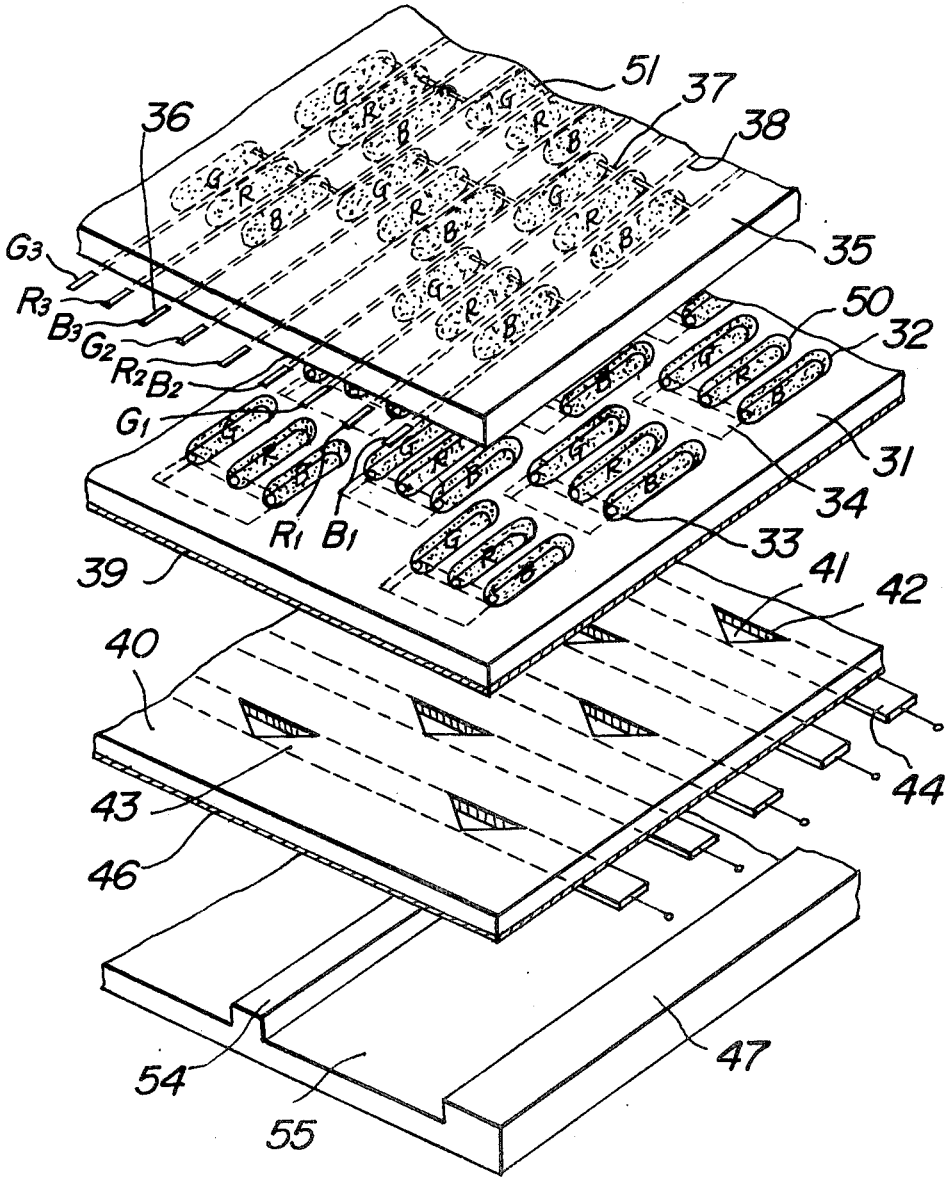
FIG. 10 is an exploded perspective view illustrating another embodiment of the display panel according to the invention.

FIG. 10 is an exploded perspective view showing another embodiment of the display panel according to the invention, which does not comprise the scanning anodes. The construction of this display panel is generally same as that shown in FIG. 6. Since the scanning anodes are not provided the cathode coupling conductor 43 does not have the projections 45. Although it is not necessary to form the grooves 48 on the front surface of the rear sheet 47, in the embodiment shown in FIG. 10 there are formed a number of spacers 54 on the front surface of the rear sheet 47 so as to confine a number of elongated discharge spaces 55 extending in a direction perpendicular to the cathode conductor 43. Such spaces 55 can store a large amount of the ionizable gas and guarantee a uniform operation of the displaying discharge units. In general if the scanning anodes are not provided, the operation voltage of the discharge unit might be increased and the response speed might be decreased. In order to avoid such drawbacks according to this embodiment the discharge spaces 55 are provided. Charged particles produced in the discharge units are moved or diffused into the spaces through the through holes 41 of the hollow cathodes 42 and the charged particles thus moved can promote the discharge operation of adjacent discharge units. In practice when the display panel displays the television image a part or a substantial part of the discharge units are operated simultaneously and thus the remaining discharge units can be actuated with a lower voltage by utilizing the charged particles.

Figure 11A:
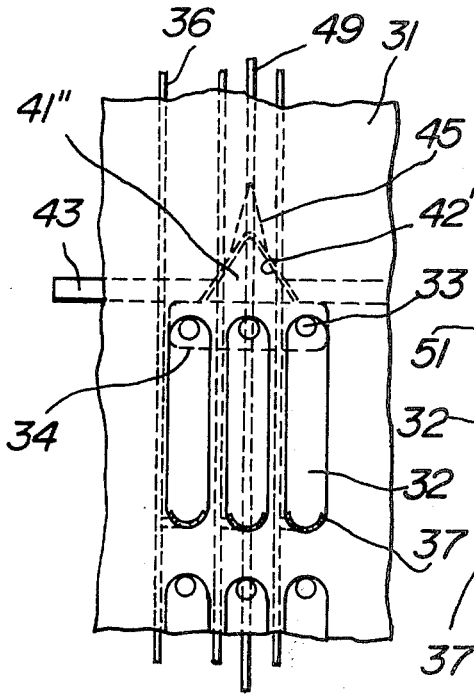
FIG. 11(*a*) is a plan view showing still another embodiment of the display panel according to the invention and FIG. 11(*b*) is an exploded cross sectional view showing the construction of the discharge unit thereof.
Figure 11B:
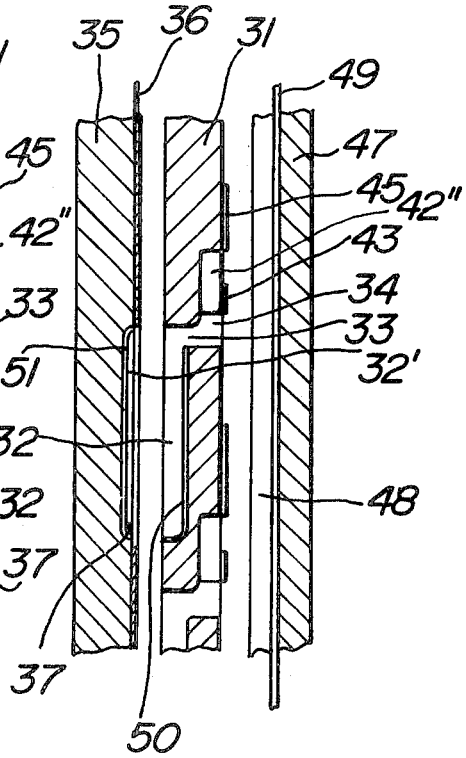

FIGS. 11(*a*) and 11(*b*) are plan view and an exploded sectional view, respectively of still another embodiment of the display panel according to the invention. The construction of the discharge space of this embodiment is similar to that of FIG. 7. An intermediate sheet 31 has formed on its front surface a number of recesses 32 and an front sheet 35 has formed on its rear surface a number of corresponding recesses 32'. On the inner surfaces of these recesses are applied three kinds of fluorescent layers 50 and 51. Near one end portions of each recess is provided an anode 37. The other end portions of three adjacent recesses 32 are communicated with a common recess 34 formed on the rear surface of the sheet 31 by means of three adjacent conduits 33. In this embodiment a hollow cathode is formed in the intermediate sheet 31. For this purpose a number of triangular recesses 41'' are formed on the rear surface of the sheet 31 and conductive coatings are applied on the inner surfaces of the recesses 41'' to form a number of hollow cathodes 42''. The hollow cathodes 42'' are partially communicated with the corresponding recesses 34 and are connected to cathode coupling conductors 43.

Figure 12:
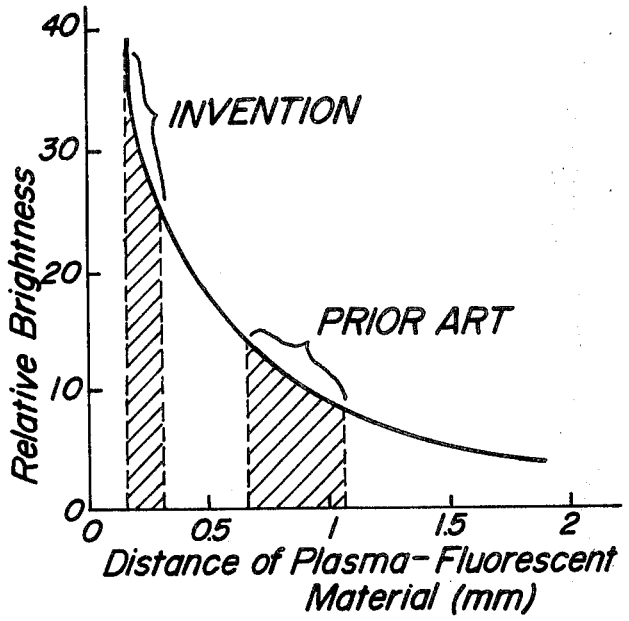
FIG. 12 is a graph illustrating a luminescent brightness property of the fluorescent layer with respect to a distance between plasma and fluorescent material.

FIG. 12 is a graph showing a brightness property of the fluorescent material with respect to a distance from the fluorescent material and plasma. As shown in the graph the light intensity of the fluorescent material increases exponentially with decreasing said distance. According to the invention since the discharge space is shaped in the elongated section extending in the plane of the display panel and the fluorescent layer is provided along this discharge space, plasma is produced at a position very near the fluorescent material, so that the brightness is quite high. On the contrary according to the known gaseous discharge display panel the distance between the fluorescent material and plasma is very long and thus the brightness of the emitted light is rather low.

Figure 13:
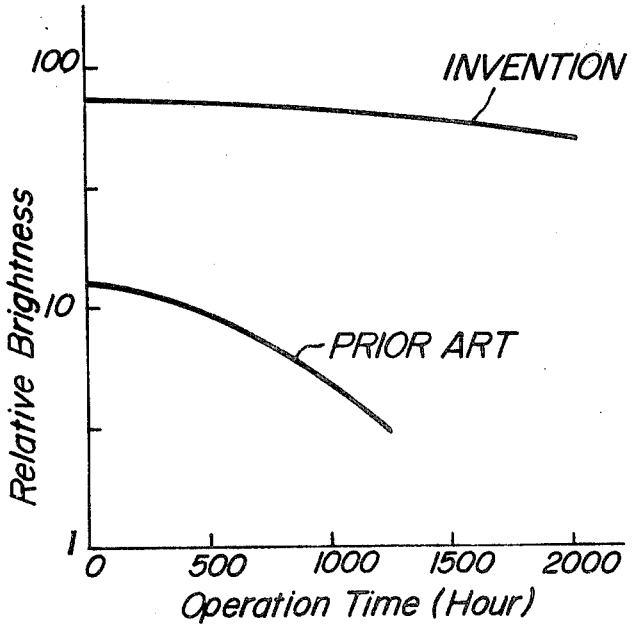
FIG. 13 is a graph showing a brightness changes of the fluorescent layer of the display panels according to the invention and that of a known display panel.

FIG. 13 is a graph illustrating a brightness property of the fluorescent material with respect to time. As explaind above according to the invention the hollow cathode is provided at such a position that it does not directly face the fluorescent layer and thus the fluorescent layer is hardly affected by the spattering of the cathode material and is hardly blackened. Therefore the high brightness can be obtained during a quite long time. Whilst in the known display panel since the cathode faces directly the fluorescent layer, the fluorescent layer may be easily blackened due to the cathode spattering and thus the brightness decreases soon to a great extent.

The present invention is not limited to the embodiments explained above, but many modifications are possible within the scope of the invention. For example, in the above embodiments the opaque layer 8, 46 is applied on the rear surface of the sheet 6, 40 so as to block stray light from the glow discharge. This may be accomplished or enhanced by forming the intermediate sheet 1, 31 by opaque material such as colored glass or by cementing the front and intermediate sheets with opaque adhesive. The opaque layer 8, 46 may be also applied to the front surface of the sheet 6, 40. Moreover the hollow cathode and the communication channel may be shaped in various forms.

What is claimed is:

1. A gaseous discharge display panel of multilayer construction comprising a transparent front sheet of electrically insulating material;

a rear sheet of electrically insulating material;

an intermediate sheet of electrically insulating material inserted between the front and rear sheets and having a number of first recesses formed in its front surface, the first recesses being shaped in elongated sections extending along the plane of the intermediate sheet, a number of second recesses formed in its rear surface, and a number of communication channels for communicating said first and second recesses at one end portions of the first recesses;

a number of anode means, each being provided near the other end portion of the respective first recess;

a number of hollow cathode means, each being provided between the rear surface of the intermediate sheet and an inner surface of the rear sheet at that portion of the respective second recess which is remote from a portion at which the communication channel is opened; and a number of fluorescent layers, each being applied at least on bottom surface of the respective first recess; whereby at least said front and intermediate sheets are hermetically sealed to form a number of elongated discharge spaces, each defined by the rear surface of the front sheet and the respective one of the first recesses formed in the intermediate sheet, said discharge spaces are communicated with said second recesses through said communication channels and filled with an ionizable gas, and said fluorescent layers are excited by ultraviolet rays emitted from positive columns formed in the discharge spaces to produce visible light.

2. A gaseous discharge display panel according to claim 1, wherein said hollow cathode means comprises an electrically conductive plate inserted between said intermediate sheet and the rear sheet and having a number of through holes formed therein, the through holes being communicated with said communication channel.

3. A gaseous discharge display panel according to claim 2, wherein said through holes formed in the electrically conductive plate an of a circular shape.

4. A gaseous discharge display panel according to claim 1, wherein said hollow cathode means comprises an electrically insulating plate inserted between said intermediate sheet and said rear sheet and having a number of through holes formed therein, each through hole being communicated with the respective communication channel and, electrically conductive coatings are applied on inner surfaces of the through holes.

5. A gaseous discharge display panel according to claim 4, wherein said through holes formed in the electrically insulating plate are of a circular shape.

6. A gaseous discharge display panel according to claim 4, wherein said through hole formed in the electrically insulating plate are of a triangular shape.

7. A gaseous discharge display panel according to claim 4, wherein each of said through holes formed in the electrically insulating plate has a projection having a sharp corner.

8. A gaseous discharge display panel according to claim 1, wherein said second recess formed in the rear surface of the intermediate sheet is made large enough to form a large space for storing a large amount of ionized gas.

9. A gaseous discharge display panel according to claim 1, wherein said anode means comprises electrical conductors, each arranged along the longer sides of a plurality of the first recesses and electrically insulating coatings applied on the conductors except for those portions which locate near the other end portions of first recesses.

10. A gaseous discharge display panel according to claim 1, wherein said anode means comprises electrically conductive coatings applied on side walls for confining the other ends of the first recesses and electrical conductors arranged along the longer sides of the first recesses, whereby said electrically conductive coatings are connected to the electrical conductors.

11. A gaseous discharge display panel according to claim 1, wherein said anode means comprises electrical conductors arranged along the rear surface of the front sheet.

12. A gaseous discharge display panel according to claim 1, wherein said rear sheet includes at least one groove in which is arranged a scanning anode in the form of an electrical conductor.

13. A gaseous discharge display panel according to claim 1, wherein the fluorescent layers are further applied on those portions of the rear surface of the front sheet which confine the first recesses.

14. A gaseous discharge display panel according to claim 1, wherein in order to display a color image said number of the first recesses formed in the front surface of the intermediate sheet is divided into a number of groups each comprising three adjacent first recesses, said second recess formed in the rear surface of the intermediate sheet is shaped in the elongated recess extending in the direction perpendicular to the longitudinal axis of the first recesses to cover the three adjacent first recesses and each of said second recess is communicated with the three adjacent first recesses and with the common hollow cathode.

15. A gaseous discharge display panel according to claim 14, wherein each of said second recesses formed on the rear surface of the intermediate sheet is extended under the three adjacent first recesses on the front surface.

16. A gaseous discharge display panel according to claim 14, wherein a respective one of three kinds of the fluorescent layers each of which radiates a respective one of three primary colors for displaying the color image is applied on an inner wall of the respective one of the three adjacent first recesses.

17. A gaseous discharge display panel according to claim 16, wherein the front sheet has a number of elongated recesses formed in its rear surface, each of said recesses facing a respective one of the first recesses in the front surfaces of the intermediate sheet and the fluorescent layers are also applied on the inner surfaces of the recesses formed in the rear surface of the front sheet.

18. A gaseous discharge display panel according to claim 1, wherein said intermediate sheet is made of an opaque material.

19. A gaseous discharge display panel according to claim 1, wherein said front and intermediate sheets are hermetically sealed with an opaque adhesive material.

20. A gaseous discharge display panel according to claim 1, wherein said first recesses are arranged in a matrix form.

21. A gaseous discharge display panel according to claim 20, wherein in order to display an image with an interlaced scanning mode the first recesses are aligned in a first direction of the matrix arrangement and are arranged in a zig-zag manner in a second direction in the matrix arrangement, said second direction being perpendicular to the first direction.

22. A gaseous discharge display panel according to claim 20, wherein in order to display an image in a noninterlaced scanning made the first recesses are aligned in first and second directions in the matrix arrangement, said first and second directions being at right angles to each other in the matrix arrangement.

23. A gaseous discharge display panel according to claim 20, wherein the anode means comprises a number of common electrical conductors extending in the first direction of the matrix arrangement.

24. A gaseous discharge display panel according to claim 23, wherein said hollow cathode means comprises a number of common cathode conductors extending in the second direction of the matrix arrangement.

25. A gaseous discharge display panel according to claim 24, wherein said rear sheet has a number of grooves on its front surface, said grooves extending in the first direction of the matrix arrangement, and a number of scanning anode conductors are provided in said grooves.

* * * * *